US006550644B2

(12) United States Patent
Cruddas

(10) Patent No.: US 6,550,644 B2
(45) Date of Patent: Apr. 22, 2003

(54) VISCOUS FLUID APPLICATOR

(76) Inventor: Leonard Cruddas, 6 Dunslade Crescent, Quarry Bank, Brierley Hill, W. Midlands DY5 3EA (GB)

( * ) Notice: Subject to any disclaimer, the term of this patent is extended or adjusted under 35 U.S.C. 154(b) by 0 days.

(21) Appl. No.: 10/006,536

(22) Filed: Dec. 5, 2001

(65) Prior Publication Data

US 2002/0070231 A1 Jun. 13, 2002

(30) Foreign Application Priority Data

Dec. 11, 2000 (GB) ..... 0030222

(51) Int. Cl.[7] ..... B67D 5/00

(52) U.S. Cl. ..... 222/83; 222/151; 222/546; 222/563

(58) Field of Search ..... 222/83, 151, 543, 222/546, 567, 563

(56) References Cited

U.S. PATENT DOCUMENTS

| | | | | | |
|---|---|---|---|---|---|
| 193,760 | A | * | 7/1877 | Hauck | 222/151 |
| 2,249,832 | A | | 7/1941 | Hubschman | |
| 2,522,864 | A | | 9/1950 | Degroff | |
| 2,798,644 | A | | 7/1957 | Root | |
| 2,957,501 | A | | 10/1960 | Holmes | |
| 3,486,503 | A | | 12/1969 | Porter et al. | |
| 3,578,224 | A | * | 5/1971 | Greenhut | 222/546 |
| 4,146,152 | A | | 3/1979 | Ogawa et al. | |
| 4,382,530 | A | | 5/1983 | Calisto | |
| 4,408,699 | A | * | 10/1983 | Stock | 222/149 |
| 4,681,243 | A | | 7/1987 | Takasugi | |
| 4,961,517 | A | | 10/1990 | Tkac | |
| 5,046,877 | A | | 9/1991 | Longo | |
| 5,154,327 | A | | 10/1992 | Long | |
| 5,261,572 | A | | 11/1993 | Strater | |
| 5,275,312 | A | | 1/1994 | Labruzzo | |
| 5,356,050 | A | | 10/1994 | Hahn et al. | |
| 5,725,722 | A | | 3/1998 | Eshleman | |
| 5,799,829 | A | * | 9/1998 | Lier et al. | 222/542 |
| 6,213,349 | B1 | * | 4/2001 | Yan | 222/567 |

* cited by examiner

*Primary Examiner*—David A. Scherbel
*Assistant Examiner*—Melvin A Cartagena
(74) *Attorney, Agent, or Firm*—Thomas R. Lampe

(57) ABSTRACT

An applicator for masking fluid comprising a fluid reservoir and a supply which feeds the fluid to a dispensing nib. The nib consists of a hollow tube through which fluid flows. The applicator incorporates an end cap having a prong which passes through the nib for the purpose of sealing and cleaning the nib.

5 Claims, 2 Drawing Sheets

VISCOUS FLUID APPLICATOR

TECHNICAL FIELD

This invention relates to an applicator for viscous fluid, more particularly, but not exclusively, for masking fluid.

BACKGROUND OF THE INVENTION

The use of masking fluid by artists is well known. It is frequently used when creating artistic works such as paintings, with inks, watercolors, acrylic paints and the like. There are great difficulties however, in applying the masking fluid, which is normally viscous. Some artists use a ruling or drawing pen. However, this requires the viscosity of the masking fluid to be reduced, usually by watering down the fluid. Others use a brush, with the consequent problem of fluid congealing on the brush and the difficulty of applying the masking fluid accurately when using a brush, particularly on fine work. A different viscosity is required for brush work than is required for an art pen, causing a number of different containers to be in use at one time and frequently resulting in confusion and waste.

The following United States Patents are believed to be representative of the current state of the prior art in the relevant dispenser field: U.S. Pat. No. 4,146,152, issued Mar. 27, 1979, U.S. Pat. No. 2,957,501, issued Oct. 25, 1960, U.S. Pat. No. 2,798,644, issued Jul. 9, 1957, U.S. Pat. No. 2,249,832, issued Jul. 22, 1941, U.S. Pat. No. 5,356,050, issued Oct. 18, 1994, U.S. Pat. No. 5,261,572, issued Nov. 16, 1993, U.S. Pat. No. 4,681,243, issued Jul. 21, 1987, U.S. Pat. No. 5,275,312, issued Jan. 4, 1994, U.S. Pat. No. 2,522,864, issued Sep. 19, 1950, U.S. Pat. No. 4,961,517, issued Oct. 9, 1990, U.S. Pat. No. 3,486,503, issued Dec. 30, 1969, U.S. Pat. No. 5,725,722, issued Mar. 10, 1998, U.S. Pat. No. 5,154,327, issued Oct. 13, 1992, U.S. Pat. No. 5,046,877, issued Sep. 10, 1991, and U.S. Pat. No. 4,382,530, issued May 10, 1983.

More of the disclosed patents disclose the combination of structural elements incorporated in the invention disclosed and claimed herein.

DISCLOSURE OF INVENTION

The object of this invention is to provide a means of allowing masking fluid to be applied in a convenient and precisely controlled manner, avoiding the current known difficulties including the possibility of accidental spillage.

According to the present invention there is provided an applicator for masking fluid, comprising a fluid reservoir and supply means which feeds the fluid to a nib. The nib consists of a hollow tube through which the fluid flows, such flow being caused by pressure applied to the reservoir such that it deforms the walls or by any other driving means which creates a fluid flow through the nib.

A further aspect of the present invention is that after use a cap is placed on the supply means, further referred to, by way of example as the spout, such cap covering the nib. This cap incorporates a prong that slides through the nib acting as a seal when the applicator is not in use. The prong also acts as a nib cleaning tool by keeping the hollow interior of the nib clear of dried fluid.

Other features, advantages and objects of the present invention will become apparent with reference to the following description and accompanying drawings.

BEST MODE FOR CARRYING OUT THE INVENTION

Figure 3:
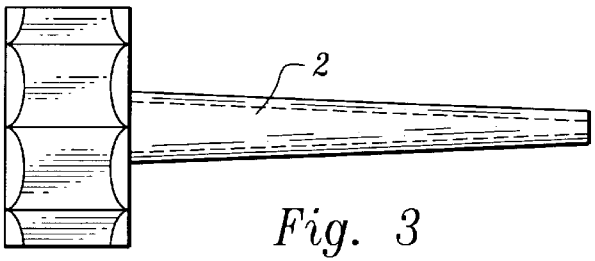
FIG. 3 is an elevational view showing the supply means, in the form of a spout.
Figure 1:
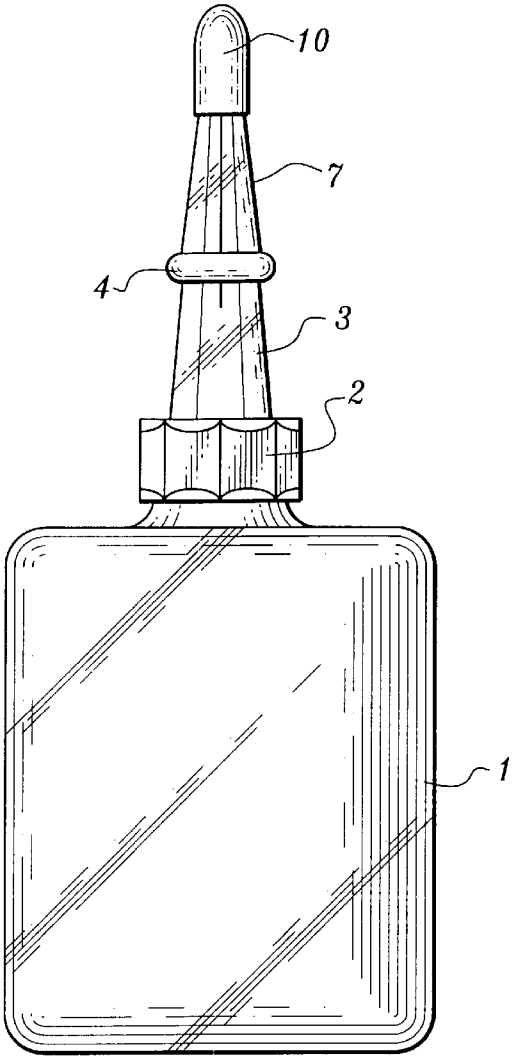
FIG. 1 is an elevational view showing the complete applicator assembly.

Referring to FIG. 1, the complete applicator consists of a body or reservoir 1 to which is attached a spout 2. The spout 2 is formed into a screw cap at one end with which it is attached to the body or reservoir 1. The spout 2 is separately shown in FIG. 3.

Figure 2:
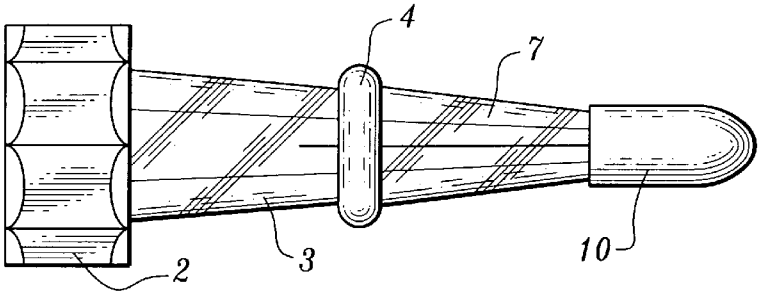
FIG. 2 is an elevational view illustrating the spout assembly, including covers, O ring and end cap assembly.

FIG. 2 shows the spout with covers and an end cap assembly which together constitute the full spout assembly which will now be described in further detail.

The spout 2 (FIG. 3) is used to deliver fluid to a nib 6 (FIG. 4) such nib being an essential element of this invention. The purpose of the nib 6 is to deliver fluid to the surface to which it is to be dispensed in such manner that the flow can be controlled by applying pressure to the reservoir. The nib is a hollow tube, which may be flexible, but less so than the spout, and which is formed with an angled surface at the distal end defining an angle with the longitudinal axis of the nib and a shoulder at the proximal end.

Figure 4:
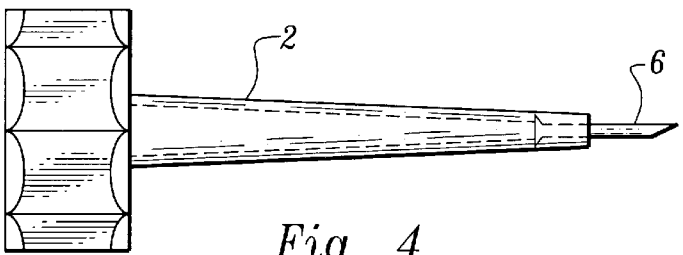
FIG. 4 is an elevational view the spout with nib attached.
Figure 6:
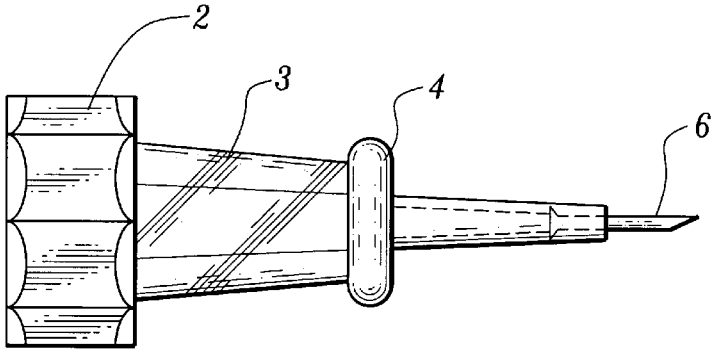
FIG. 6 is an elevational view showing the spout sub assembly without end cap assembly.

The shoulder is formed by applying heat, with an appropriately shaped tool, and deforming the tube to form the shoulder. The nib 6 is then inserted in to the proximal end of the spout and driven forward inside the spout towards the distal end of the spout with a suitably shaped and heated tool. This seals the nib into the distal end of the spout as is shown in FIG. 4 wherein the nib 6 is attached to the spout 2. The cover 3 and the O ring 4 are added to the spout to form the spout sub assembly shown fully in FIG. 6.

Figure 5:
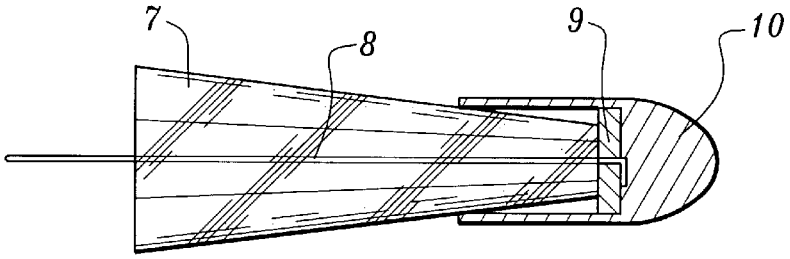
FIG. 5 is an elevational depiction of the end cap assembly of the invention.
Figure 7:
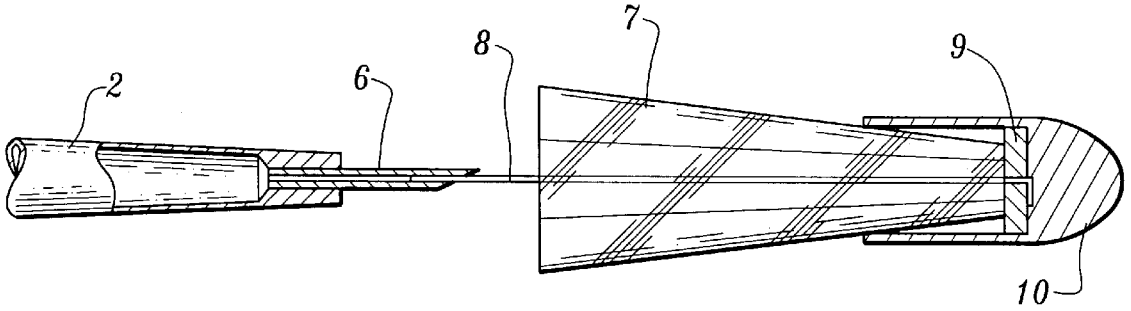
FIG. 7 is an elevational view illustrating the prong of the invention entering the nib.

To complete the full spout assembly shown in FIG. 2, an end cap assembly (shown in FIG. 5) is added. The purpose of the end cap assembly is to seal the nib and prevent unwanted egress of fluid and ingress of air when the applicator is not in use. An essential element in this process is the prong 8, which is retained in the end cap assembly. The prong 8 passes into the hollow tube which is the nib when the end cap assembly shown in FIG. 5 is pushed on to the spout sub assembly (FIG. 6) to form the full spout assembly shown in FIG. 2. The entry of the prong into the nib is shown in FIG. 7.

Construction of the end cap assembly will now be described in detail with reference to FIG. 5.

The end cap assembly consists of an elongated hollow member or tube 7, the tube 7 shaped to fit over the spout 2. At the distal end of the tube 7 is a prong retaining washer or element 9, which is pierced in the center to allow the prong to pass through. The prong 8 is inserted through the prong retaining washer 9, so that is extends through the tube 7 and out of the open end of the tube 7, so as to become visible. This is necessary so that when the end cap assembly is mounted on to the spout sub assembly, the process of which is shown in FIG. 7, the prong is visible to the user. This visibility allows the user to insert the prong into the nib before the end cap assembly is fully pushed on to the spout sub assembly. When the cap assembly is fully pushed onto the spout subassembly, the open end of tube 7 engages O-ring 4 to form a seal.

The prong also assists the sealing function performed by the end cap assembly but at the same time performs a dual function in that it also acts as a cleaning tool by keeping the hollow interior of the nib clear of dried fluid.

Prong 8 is formed from a piece of rigid wire or any material which could be formed into a shape to push into the nib. The prong is formed with a stop shoulder at one end which rests upon the prong retaining washer. In the example given, the prong is formed from wire and is bent at a right angle at one end to form the stop shoulder. Construction of the end cap assembly is then completed by adding an end cap 10 to seal the end and retain the prong retaining washer.

There are various other components and assembly methods which can be used to reproduce this invention but it is envisaged that either actual or equivalent components to the nib and or the prong would be used to apply fluid from some form of reservoir.

The invention claimed is:

1. A dispenser for masking fluid or other viscous fluid, said dispenser comprising, in combination:

a viscous fluid reservoir;

a spout having a spout proximal end and a spout distal end connected to said reservoir at said spout proximal end;

a hollow nib attached to the spout at the spout distal end and projecting outwardly from said spout distal end, said hollow nib for receiving viscous fluid supplied to said spout from said reservoir, and said hollow nib having an open distal fend spaced from said spout for dispensing viscous fluid received by said hollow nib from said spout;

an end cap assembly releasably attached to said spout, said end cap assembly including a hollow member and an end cap, said hollow member having an open hollow member proximal end for releasable engagement with said spout and a hollow member distal end, said end cap being releasably connected to said hollow member distal end, said hollow member when releasably engaging said spout accommodating therein a portion of said spout and said nib, and said end cap assembly further including a prong attached to said hollow member at said hollow member distal end and extending within said hollow member in the direction of said hollow member proximal end, said prong being removably positioned in said hollow nib to seal said hollow nib and prevent egress of viscous fluid from said hollow nib and operable to contribute to cleaning of said hollow nib when inserted therein, said prong having a prong distal end, and said prong projecting from the hollow member proximal end with said prong distal end spaced from and disposed outwardly of the hollow member proximal end; and an O-ring connected to and surrounding said spout between the spout proximal end and the spout distal end engaged by said hollow member proximal end and forming a seal between said spout and said hollow member when said hollow member releasably engages said spout.

2. The dispenser according to claim 1 wherein the open distal end of said hollow nib defines an angle with a longitudinal axis of said nib.

3. The dispenser according to claim 1 wherein said nib includes a shoulder at an end thereof, said shoulder being located within said spout at said spout distal end and affixed thereto.

4. The dispenser according to claim 1 wherein said end cap assembly additionally includes a prong retaining member connected to said hollow member, said prong including a stop shoulder engaging said prong retaining member to restrict movement of said prong relative to said hollow member.

5. The dispenser according to claim 4 wherein said end cap assembly includes an end cap attached to said hollow member and retaining said prong retaining member and prong in position relative to said hollow member.

* * * * *